United States Patent [19]

Wellington et al.

[11] Patent Number: 4,782,898

[45] Date of Patent: Nov. 8, 1988

[54] DETERMINING RESIDUAL OIL SATURATION USING CARBON 14 LABELED CARBON DIOXIDE

[75] Inventors: Scott L. Wellington; Edwin A. Richardson, both of Houston, Tex.

[73] Assignee: Shell Oil Company, Houston, Tex.

[21] Appl. No.: 873,558

[22] Filed: Jun. 12, 1986

[51] Int. Cl.[4] ..... E21B 47/00; E21B 49/00; G01N 33/24

[52] U.S. Cl. ..... 166/252; 166/300; 436/27; 436/29

[58] Field of Search ..... 436/27-33, 436/56; 166/250, 270, 274, 273, 300, 307, 308, 252

[56] References Cited

U.S. PATENT DOCUMENTS

| | | | |
|---|---|---|---|
| 3,532,165 | 10/1970 | Raifsnider | 166/270 |
| 3,623,842 | 11/1971 | Deans | 436/27 |
| 3,751,226 | 8/1973 | Hesse et al. | 436/27 |
| 3,801,281 | 4/1974 | Thompson et al. | 436/33 |
| 3,847,548 | 11/1974 | Keller et al. | 436/27 |
| 3,856,468 | 12/1974 | Keller | 436/27 |
| 3,990,298 | 11/1976 | Deans | 166/252 X |
| 3,993,131 | 11/1976 | Riedel | 436/27 |
| 4,099,565 | 7/1978 | Sheely et al. | 166/252 |
| 4,122,896 | 10/1978 | Scheuerman et al. | 166/307 X |
| 4,168,746 | 9/1979 | Sheely | 436/27 X |
| 4,646,832 | 3/1987 | Richardson | 436/29 X |

FOREIGN PATENT DOCUMENTS

| | | | |
|---|---|---|---|
| 594807 | 3/1960 | Canada | 436/27 |

*Primary Examiner*—Barry S. Richman
*Assistant Examiner*—Robert J. Hill, Jr.

[57] ABSTRACT

Residual oil saturation is determined by injecting an aqueous solution containing a carbonate salt, an acid-generating material and a radioactive material which are each selectively water soluble, displacing the solution with an aqueous solution devoid of the reactants and tracer, and, after $CO_2$ has formed within the reservoir, producing aqueous fluid from the reservoir and utilizing radioactive analysis to measure the chromatographic separation between the radioactive material and the $CO_2$.

8 Claims, 3 Drawing Sheets

DETERMINING RESIDUAL OIL SATURATION USING CARBON 14 LABELED CARBON DIOXIDE

RELATED APPLICATIONS

This application is related to the commonly assigned U.S. Pat. Nos. 4,646,832, issued Mar. 3, 1987, and 4,617,994, issued Oct. 21, 1986 by E. A. Richardson, on determining residual oil saturation by injecting, respectively, a carbonic acid salt and an acid-generating material, or $CO_2$ and a base-generating material, and our commonly assigned and concurrently filed patent application Ser. No. 873,555 relating to determining residual oil saturation by radioactively analyzing at least one material in an injected solution which initially contained $CO_2$ and base-generating reactant. The disclosures of those applications are incorporated herein by reference.

BACKGROUND OF THE INVENTION

This invention relates to determining the relative concentrations of oil and water phase fluids within subterranean reservoirs by measuring the chromatographic separation of tracers having distinctly different partitioning coefficients in mobile and immobile phases, i.e. the respective water and oil phases, of fluids within reservoirs. More particularly, the present invention relates to improving a process for making such determinations by radioactively analyzing tracers formed by injecting an aqueous solution of reactants arranged to form $CO_2$.

A method for determining the relative amounts of water and oil fluid phases within a subterranean reservoir by injecting carrier fluid containing a reactant, such as ethyl acetate, capable of forming within the formation at least two tracers having different partitioning coefficients between the carrier fluid and the oil, and then measuring the chromatographic separation of the tracers, was described in 1971 in U.S. Pat. No. 3,623,842. U.S. Pat. No. 3,751,226 by R. J. Hesse and R. F. Farmer relates to improving such a process by injecting a solution in which the tracer forming reactant is a hydrolyzable beta-keto ester such as ethylacetolacetate. U.S. Pat. No. 3,847,548 relates to improving such a process by injecting carrier fluid containing tracers which partition differently with respect to temperature changes and injecting that fluid at a temperature different from the reservoir temperature. U.S. Pat. No. 3,856,468 relates to improving such a process by injecting carrier fluid containing both a precursor which forms a tracer material that partitions between the fluid phases and a tracer material which is inert and substantially completely dissolved in the mobile phase. U.S. Pat. No. 3,990,298 relates to improving such a process by injecting a carrier fluid containing a plurality of precursors each of which forms a tracer which has a distinctive partition coefficient with at least one mobile fluid phase within the reservoir. U.S. Pat. Nos. 4,099,565 and 4,168,746 relate to uses of such a fluid saturation determining process for evaluating the effectiveness of a design process for recovering oil.

U.S. Pat. No. 4,122,896 by R. F. Scheuermann, E. A. Richardson and C. C. Templeton relates to acidizing a reservoir by injecting an aqueous solution of halocarboxylic acid salt so that the rate of the acidization is limited to the rate of its hydrolysis. The disclosures relating to the hydrolysis of halocarboxylic acids contained in that patent are incorporated herein by reference.

SUMMARY OF THE INVENTION

The present invention relates to improving a process in which a reactant-containing aqueous solution is injected into and displaced within a subterranean reservoir for reacting in situ to provide tracers having different partition coefficients relative to the oil and water fluid phases within the reservoir so that the chromatographic separation of the tracers can be utilized for determining the relative saturations of the fluid phases. The present improvement is effected by injecting as the tracer-providing solution, an aqueous solution containing solutes consisting essentially of (a) at least one each of an acid generating material and a carbonic acid salt which are each substantially oil-insoluble and are capable of reacting with water and each other within the reservoir to yield an oil tracer comprising $CO_2$ which partitions between the oil and water phases and (b) at least one radioactive water tracer which is substantially insoluble in oil and is substantially nonreactive within the reservoir. The carrier liquid solution is displaced with an aqueous solution which is free of both the acid generating material and the radioactive water tracer. The resultant tracer-containing fluid is produced from within the reservoir while radioactively measuring its content of the radioactive water tracer and measuring its content of the $CO_2$ oil tracer, for determining the chromatographic separation between those materials to determine the relative saturations of the oil and water phases in the reservoir.

DESCRIPTION OF THE INVENTION

Figure 1:
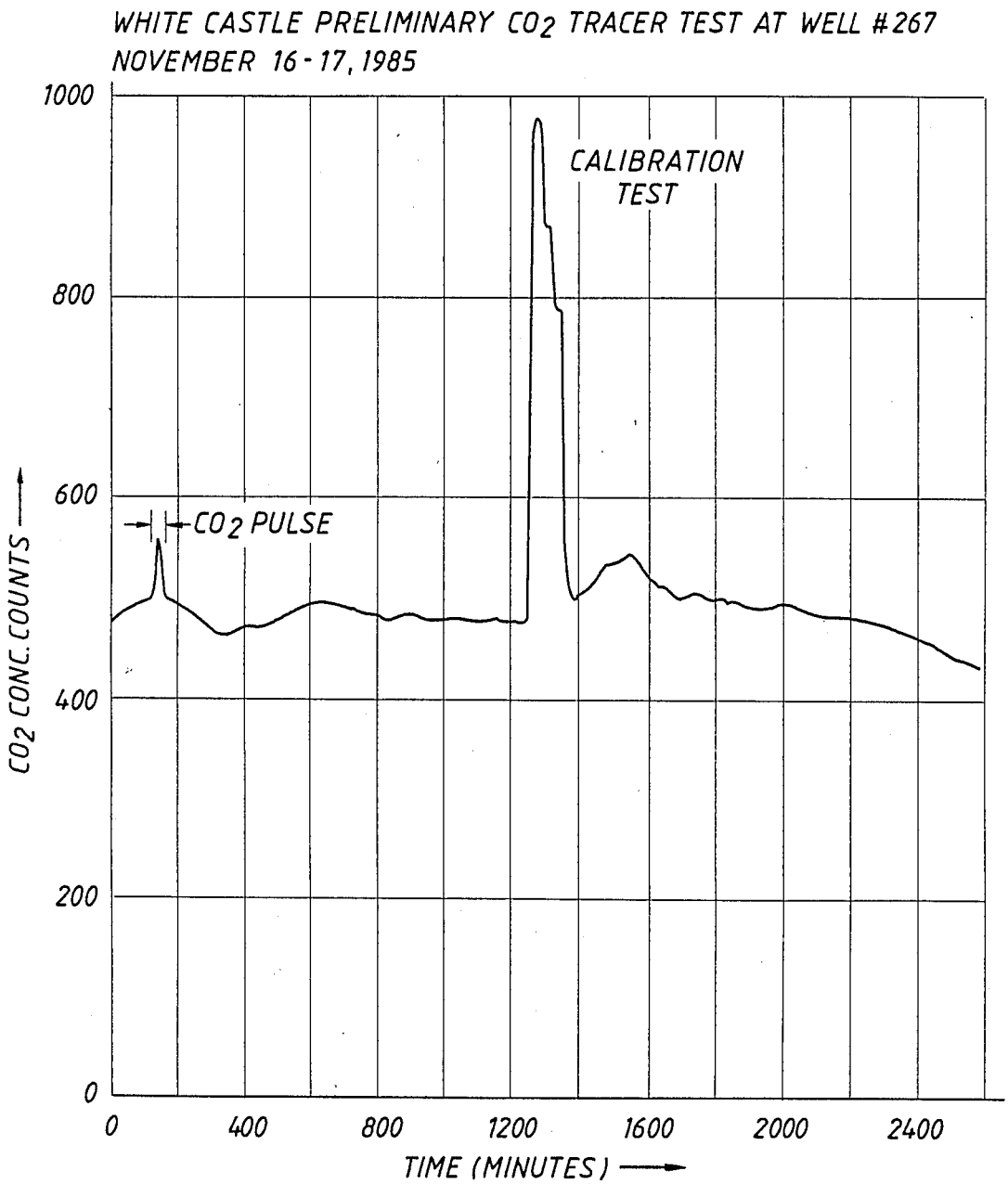
FIG. 1 is a graph of concentration of $CO_2$ in brine produced from a well.

It appears that in conventional testing operations, the only tracer-forming reactants which have heretofore been successfully utilized were hydrolyzable lower alkyl carboxylic acid esters such as those described in U.S. Pat. No. 3,623,842, or the analogous beta-ketoalkyl carboxylic acid esters which are capable of providing an unreacted ester or ketone as a tracer which is partitioning between the water and oil (or other mobile and immobile phases) and a tracer such as alcohol (or inert material) which is substantially completely dissolved in the water phase. Such prior processes have received wide industry acceptance as a "single well tracer method" and more than a hundred jobs have been done. But, in general, the dependence upon organic esters has limited the use of the method to reservoirs having moderate temperatures.

Relative to using untagged $CO_2$ as oil tracers as described in U.S. Pat. Nos. 4,646,832 and 4,617,994, the present invention is, at least in part, based on Applicants' discovery that when done in particular ways solutes comprising carbon 14 labeled carbonic acid salts and radioactively-labeled water tracer materials can be injected into a reservoir so that the carbonic acid salt is reacted with acid within the generally hostile surroundings of a subterranean oil reservoir formation to provide a solution containing readily detectable and reliable tracers. Also, the amounts of the radioactive labeling materials can be used in concentrations too small to require licenses for disposal.

The present invention involves a discovery that the present process provides a carrier fluid-precursor solution having most, if not all, of the properties described as being "ideal" but, in practice, unattainable, in column 8 of the Keller U.S. Pat. No. 3,856,468. And, the present process provides an oil saturation measuring procedure which is significantly improved relative to one using an alkyl ester, amine hydrofluoride, alkyl sulfate salt or carbonate, such as the precursors designated to be suitable for use in the Keller process.

The present invention also involves a discovery that, in the particular manner described, the process disclosed in the Richardson U.S. Pat. No. 4,646,832, for using in situ generated $CO_2$ as the oil tracer, can be significantly improved by means of relatively fast, accurate, and reservoir component interference-free radioactivity measurements, for detecting the arrival of at least the water tracer and, optionally, for both the water and the oil tracer.

Applicants discovered that—although radioactive tracer materials and measuring equipment are generally available and known to be useful for particularly rapid and accurate determinations of arrivals of radioactive tracer compounds—in a process for measuring residual oil saturation by using $CO_2$ as an oil tracer, the advantages of such radioactive measurements are highly effective if, but only if, the radioactivity measurement is employed in a particular way. It should be used to detect the arrival of the water tracer but not the oil tracer except in a situation where there is no bicarbonate ion in the reservoir brine or in the brine that is injected into the reservoir prior to the injection of the tracer containing slug and that sufficient brine devoid of bicarbonate must be injected prior to the tracer slug so that convective mixing with brine containing bicarbonate ions does not interfere with the results.

In view of this, although carbonic acid salts containing $C_{14}$ labeled carbon atoms can readily be used to form $C_{14}$ labeled $CO_2$, if that $CO_2$ is utilized as an oil tracer, the detection of its radiation may not be coincident with the arrival of the $CO_2$ that is chromatographically delayed between the oil and water phases; except in the situation described above.

In an aqueous solution containing dissolved $CO_2$, the dissolved gas is converted into ions of carbonic acid and those ions are converted into dissolved gas at rates maintaining proportions of gas and ions responsive to the pressure and temperature of the solution. When such a solution contacts an oil, some water-dissolved $CO_2$ becomes dissolved in oil and some oil-dissolved $CO_2$ becomes dissolved in water, at rates, and to extents, maintaining the partitioning coefficient between the oil and water. In such a situation, if the $CO_2$ contains radioactively tagged carbon atoms and $CO_2$-containing solution is displaced relative to the oil, some of the tagged carbon atoms in the ions of carbonic acid are displaced along with the water and the arrival of the radiation from those ions does not demark the arrival of the $CO_2$ which was delayed by being partitioned between the oil and water phases; except in the case described above where the $C_2$-displacing solution is at least substantially free of dissolved bicarbonate ions.

In a field test in which a reactant-containing aqueous solution and brine were injected into a reservoir and produced by gas lifting, it was found that adequate amounts of $CO_2$ remained in the brine after the gas-lifting operation. It was also found that the amount of $CO_2$ in the brine did not change significantly or radically during the gas-lift production.

In a field test within a reservoir expected to contain oil and residual oil saturation to water, salts of carbonic and halocarboxylic acids were injected to form a $CO_2$ oil tracer and provide an acid anion water tracer. An on-line wellhead connected analysis system was operated continuously for 48 hours. The $CO_2$ concentration in the brine was quite stable, varying only between about 0.003 to 0.004 moles/liter.

The $CO_2$ analysis results are plotted in FIG. 1. The $CO_2$ tracer pulse for determining residual oil saturation can be designed to exceed the base line $CO_2$ concentration by a factor of about 5, and can be easily identified. During the test no special efforts were made to adjust or regulate the gas lift to maintain a constant production rate. As a matter of record, there were several large pressure gas flow rate excursions amounting to $\pm 50\%$ of the average noted on the field gas pressure flow meter during the test.

An ultra-mini $CO_2$ pulse was injected into the gas/liquid separator to see if its presence could be detected. The resulting concentration peak was symmetrical and well defined. It is identified on FIG. 1 just short of the 200 minute line. This test indicated that the monitoring procedure is quite sensitive to the presence of $CO_2$.

An actual $CO_2$ pulse response would be similar in height and broader than the calibration test pause appearing just behind the 1200 minute time line on FIG. 1. The preliminary test results indicated that the tracer detection procedures are substantially immune to variations in fluid production rate by gas lifting. In fact, the preliminary test results indicate that it may be easier to monitor wells which are produced by gas lift than those produced with a sucker rod pump.

Comparison of Tracer Capabilities (1) Temperature Range

In typical prior processes an organic ester which is partially soluble in oil serves as the oil phase tracer which is injected at the wellbore and displaced to the desired distance from the wellbore by an inert fluid. A soak period then allows time for a hydrolysis reaction to take place and produce a significant amount of alcohol. The alcohol is not soluble in the oil and thus serves as the water phase tracer.

The hydrolysis step must not be too fast since it is undesirable for the alcohol to be produced during the placement step and also, some unreacted ester must remain after the soak period as it is the oil phase tracer. At the end of the soak period, both tracers are produced back to the wellbore. The amount of chromatographic separation of the two tracers is measured and used to calculate residual oil saturation.

If the reservoir temperature is above about 200° F., the hydrolysis rate of most, if not all, known esters is so fast that the above requirements cannot be met. Therefore, the prior processes have been limited to reservoirs of about 200° F. or less.

The present process removes this limitation by using different tracers and different means of in situ generation. In the present process, the oil phase tracer can be carbon 14 labeled $CO_2$. That $CO_2$ is generated in situ during the soak period by injecting a suitable acid generating material, such as a halocarboxylic acid salt, along with a carbon 14 tagged salt of carbonic acid. When a halocarboxylic acid salt is used as the acid-generating material, the acid anion concentration does not change during the reactions and the anions can serve as the water phase tracer.

Where the reactants comprise sodium chloroacetate and sodium bicarbonate the reactions can be summarized as follows:

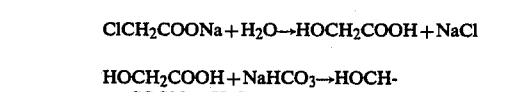

$$ClCH_2COONa + H_2O \rightarrow HOCH_2COOH + NaCl$$

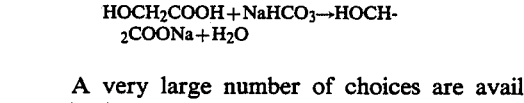

$$HOCH_2COOH + NaHCO_3 \rightarrow HOCH_2COONa + H_2O$$

A very large number of choices are available for selection of a halocarboxylic acid or other acid generator. Examples of acid generators are given in Table I along with a best estimate of the applicable temperature range for each listed $CO_2$ generator:

TABLE I

| Test | Acid Generator | Temperature Range, °F. |
|---|---|---|
| (1) | 3-Chlorobutyric acid salt | 80 to 110 |
| (2) | 3-Chloropropionic acid salt | 100 to 130 |
| (3) | 2-Chloropropionic acid salt | 120 to 150 |
| (4) | Mono Bromo Acetic acid salt | 140 to 170 |
| (5) | Mono Chloro Acetic acid salt | 160 to 220 |
| (6) | DiChloro Acetic acid salt | 180 to 250 |
| (7) | Ortho Chlorobenzoic acid salt | >300 |

TABLE I-A

| Test | Acid Generator | Temp. °F. | pH | Half Life,*1 $t_{\frac{1}{2}}$ hours |
|---|---|---|---|---|
| (8) | Succinimide | 177 | 7.0 | 28.4 |
| (9) | " | 177 | 6.0 | 184.1 |
| (10) | " | 206 | 6.0 | 31.3 |
| (11) | Maleimide | 206 | 6.0 | too fast |
| (12) | " | 140 | 6.0 | 18.4 |
| (13) | " | 96 | 6.0 | 53.6 |
| (14) | " | 76 | 6.0 | 450.1 |
| (15) | Maleimide | 109 | 6.0 | 92.0 |
| (16) | " | 109 | 7.0 | 35.0 |
| (17) | " | 110 | 6.5 | 43.8 |
| (18) | " | 110 | 5.5 | 439.0 |

*1This is the time, in hours, required for the base generator to be ½ reacted. This is a convenient way to measure the speed of a reaction.

(2) Deeper Penetration (depth of investigation) from the Wellbore

In typical prior processes the oil phase tracer is an ester (i.e., ethylacetate) which is injected within a carrier fluid. This ester partitions between the oil and the water of the carrier fluid. The effect is to retard the advance of the ester front into the reservoir. In most cases the ester will reach a distance corresponding to a volume of only about one-third that of the volume of the total fluid injected.

The present method avoids this problem because the oil phase tracer (tagged $CO_2$) is not present in the fluids being pumped (except in unavoidable minor amounts). The $CO_2$ forms mainly after the placement is complete. Thus, $CO_2$ is generated at the leading edge and throughout the solution injected and hence is about 3 times (by volume) further from the wellbore than the ester system, when the production part of the cycle starts.

Thus, the tagged $CO_2$ oil phase tracer of the present system will penetrate further into the information than an ester system tracer (for a given volume of treatment) and will provide a residual oil measurement over about 3 times the volume of reservoir sampled by the prior system.

(3) Distribution Coefficient

The distribution coefficient, Ki, (ratio of concentration of tracer in the oil phase to that in the water phase) of esters is about 6 in most cases. Ki for $CO_2$ is about 2; and this is applicable to a carbon 14 labeled $CO_2$.

The $CO_2$ value for Ki is much more optimum from a test sensitivity point of view in most cases, since more of it is present in the water phase, which comprises the substantially all of the produced fluid.

Also, the tagged $CO_2$ tracer will be produced back to the wellbore much sooner than an equivalent ester tracer would be.

If this property is combined with the smaller volumes needed for sampling the reservoir because of deeper penetrating capability of the tagged $CO_2$ tracer, only small jobs with tagged $CO_2$ tracer may be necessary. In this case, several small tagged $CO_2$ tests could be run on different wells instead of the one large ester test currently practiced. This would give better overall reservoir values for residual oil saturation than is currently possible.

(4) Drift During Soak Period

In most reservoirs, fluid injected into a well will drift with the overall reservoir fluids when the pumps are shut down. This may be as much as a few feet per day.

In the ester system, long soak periods are frequently required. This makes drift important as a source of error for which corrections must be made. Also, considerable accuracy and sensitivity is lost in the process.

In the present process, the wide choice of acid generators which react at different rates at different temperatures coupled with more rapid backflow will greatly diminish the effect of drift in many cases. This is because acid generators can be more optimally selected to correspond to the actual reservoir temperature involved. Also, the water tracer and oil tracer will stay much closer together in the reservoir and hence cancel much of the errors introduced by the reservoir drift velocity.

(5) Hydrolysis Rate vs pH

The hydrolysis rate for most substances is affected by pH. Esters have a rate constant which varies by about a factor of 10 for each 1 unit change in pH (i.e., the rate is proportional to the OH ion concentration). This proportionality means that the hydrolysis rate of an ester slows down as the pH drops due to the acid generated thereby. This means that difficulties can occur in getting enough alcohol to form in the reservoir so that enough water tracer will be available for analysis.

(6) Spending of Halocarboxylic Acids

Where the concentration of the anions of an acid-generating salt of a halocarboxylic acid are used as a water phase tracer, their hydrolysis and resultant release of the tagged $CO_2$ involves no change in the number of the anions. Thus, the concentration of the water tracer remains constant, regardless of the rate or extent of the hydrolysis reaction by which the oil phase tracer is formed.

(7) Stripping of Light Hydrocarbons from the Oil Phase

The injection of brine from surface locations results in dissolving light hydrocarbons such as methane and ethane from the residual oil first contacted in the reservoir.

In the prior unreacted ester tracer system, this "stripped" oil is the oil which is "immobile" during the chromatic production operation. During the injection the injected water front travels much faster than the ester front and, it is unlikely (1) that the light ends thus "stripped" from the oil will be recombined with the oil as the water and ester are produced back to the wellbore and (2) that this will occur before the ester again contacts that oil.

In the present tagged $CO_2$ system, a similar stripping on injection will occur. But, the production cycle is such that considerable native reservoir water will have flowed past any stripped oil before any $CO_2$ can contact the stripped oil. Of course, the $CO_2$ has not previously contacted this oil in contrast to the ester system.

(8) Miscellaneous (a) More precise positioning of the tagged $CO_2$ in the reservoir may make it possible to use frontal analysis techniques on the tracers instead of band analyses used for the esters. Frontal analyses should be more accurate.

(b) In some cases, very small amounts of the tagged $CO_2$ may be sufficient due to the high sensitivity and stability of the analyses systems.

(c) If drift is minimal, simple methods of analyzing the data and calculating the residual oil saturation may be possible.

In general, the present process can be utilized in substantially any of the reservoir situations or fluid saturation determining processes for which the prior processes were suitable.

Where a haloorganic acid salt is used in the present process, it can be substantially any which is water soluble, hydrolyzes and reacts with the carbonate salts to form tagged or not tagged $CO_2$ and a water soluble salt and is compatible with the fluids and solids in the reservoir and the other components of the tracer forming solution to be injected.

In general, the acid generating material can be substantially any material which (a) is reactive in an aqueous medium and compatible with the tracer providing solution of a carbon 14 labeled or other carbonate salt, (b) reacts slowly at the surface temperatures near the well and (c) generates acid at a reasonable rate at the formation temperatures while forming byproducts which are compatible with the other components of that solution. Examples of various suitable acid generating materials are described in U.S. Pat. No. 3,828,854 by C. C. Templeton, E. H. Street and E. A. Richardson. Examples of acid generating materials other than halocarboxylic acids include imides, anhydrides, etc.

Radioactively tagged tracers can suitably be used in conjunction with, or in place of, selectively water soluble byproducts of an acid generating material such as acid anions. A radioactively tagged water tracer can be substantially any selectively water soluble compound which eminates rays such as alpha, beta, gamma or X-rays. Suitable examples include tritiated water, water solutions containing cobalt-57 or -60 cobaltushexacyanide (usually the potassium salt) hexacyanocobaltate or $I^{125}$ salts (e.g., $NaI^{125}$). When an X-ray or low energy gamma ray emitter is used, i.e., cobalt 57, a solid scintillation counter such as $NaI(T_1)$ can be attached directly to the wellhead or production fluid flow lines for detecting the arrival of the water tracer.

Based on the results of the preliminary field tests and data available regarding surface equipment and injection and production procedures known to be useful in connection with the previously known single well tracer test method for measuring residual oil saturation, a computer program was written to calculate peak heights and arrival times of tracers travelling through porous media containing various amounts of immobile oil. Use was made of the conventional chromatographic models with the system of interest being divided into numerous small elements of volume. In the program, the equilibrium conditions for each element are calculated as fluid moves from one to the other in transit through the zone of interest. For example, a sand pack or well test and a parameter is incorporated into the program to account for mixing as the fluid flows from element to element.

The following is an example of how a single well residual oil saturation test can be conducted in accordance with the present process. Assume that the well to be tested has a temperature of about 142° F., an open interval of about 20 feet, and is capable of sustaining an injection rate of about one-half barrel per minute. The tracer providing solution can contain about 100 barrels of an 0.025 M 2-chloropropionic acid salt solution prepared with reservoir formation water (which is to be filtered to remove contaminants such as ferric oxide when pumped into the well) mixed with about a 0.02 M sodium bicarbonate solution and having a pH of about 6.0 to 6.2 in the final blend. That solution would be displaced into the reservoir by injecting about 400 barrels of filtered formation water which would cause a radial displacement (or penetration of the tracer from the wellbore) to be about 15 feet. A soak time of three days would be appropriate, followed by the production of the injected fluids at a rate of about 0.5 to 1 barrel per minute by gas lift, with the volume of produced fluid being monitored from the separator at the well site. A continuous side stream of the produced fluid can be analyzed for radioactivity and/or $CO_2$, bicarbonate 2-chloropropionic acid anion and pH. The testing can utilize standard pumping equipment available from service companies.

Figure 2:
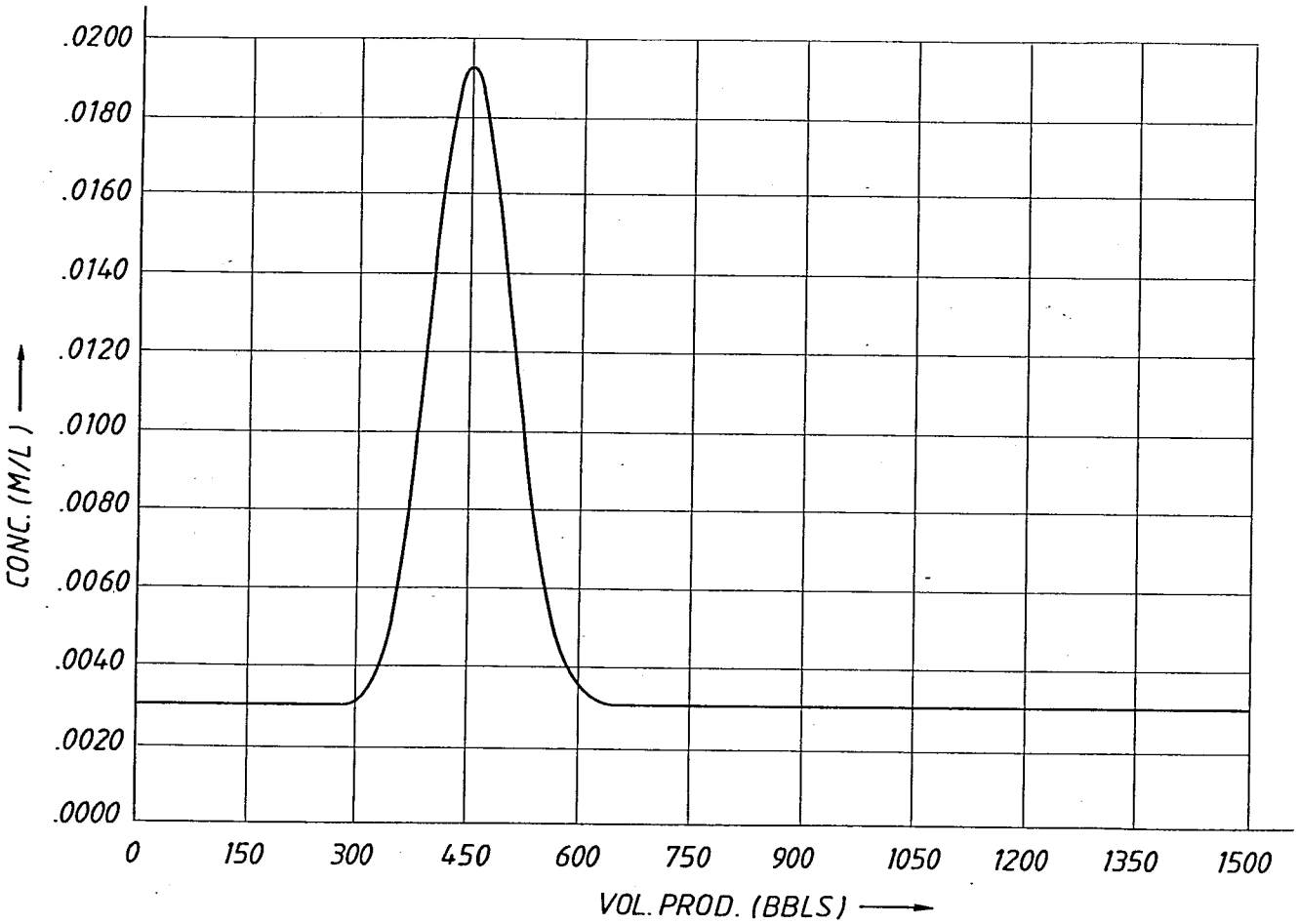
FIG. 2 shows a graph of calculated concentration of water tracer with volume of produced fluid.
Figure 3:
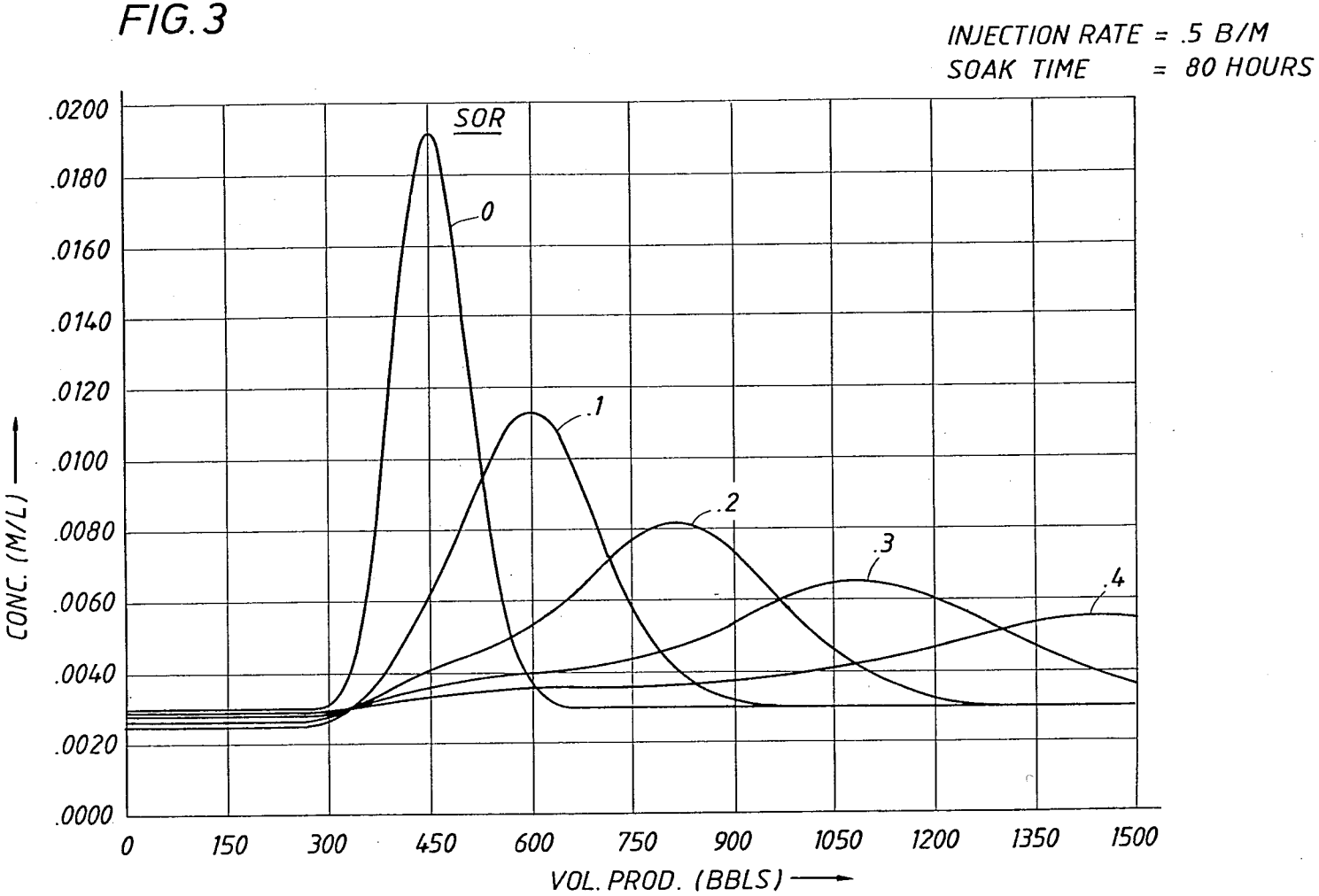
FIG. 3 shows a graph of calculated concentration of oil tracer with volume of fluid produced from earth formations containing different amounts of oil saturation.

FIG. 2 shows the calculated response for an analysis to determine the separation between the oil and water tracers at the wellbore during such a treatment. The measured pore volume of the reservoir being tested is given as the production volume attained at the peak of the water tracer curve shown in FIG. 2. The oil present in this volume of the reservoir is given by the volume difference between the water tracer peak and the oil tracer peak as shown in FIG. 3. Curve matching, using appropriate chromatographic models, is utilized to establish the residual oil saturation in the tested portion of the reservoir.

FIG. 3 shows the results of model calculations regarding the effect of various residual oil saturation values on oil tracer peak heights and positions. The peak height at residual oil saturation equal zero is essentially the same as for the water tracer at 1 pore volume to. With increases in oil content, the peaks broaden and move more slowly, so that production of about 2 pore volumes may be needed to detect the peak at the wellbore. Oil saturation values in the range of 0.1 to 0.3 are well suited for determinations by the present method. These calculations were based on determinations utilizing chemical analyses of the tracer—which can provide a desirable backup to determinations based on radiation analyses. As known in the art, by utilizing appropriate types of radiation emitters, it may be possible to further extend the range of oil saturations to which the present process is applicable.

A carbon 14 labled carbonic acid salt suitable for use in the present process can comprise substantially any so-tagged water soluble carbonate or bicarbonate containing cations which forms water soluble salts when that carbonate or bicarbonate is reacted with the acid generated by the acid-generating material, with the so-produced salts being compatible with the reservoir materials and other components of the injected tracer-forming solution. Where such a carbonic acid salt is used, in order to cause the arrival of the labeled $CO_2$ to coincide with the chromatographically delayed $CO_2$, the aqueous liquid which displaces the $CO_2$ to the measuring location should contain only an insignificant amount of dissolved bicarbonate ion. The suitability of water produced from the reservoir or other water can be determined by laboratory tests such as flowing both the water being tested and the labeled $CO_2$ through a permeable earth formation core or sand pack containing that water, or an equivalent water, and the reservoir oil, or an equivalent oil.

A tracer-forming solution suitable for use in this invention comprises an acid generator and a compatible water-soluble radioactively labeled water tracer which is substantially oil-insoluble, dissolved in an aqueous solution which contains at least one substantially oil insoluble carbonate and/or bicarbonate salt, which can be or can include a carbon 14 labeled, acid-reactive, carbonate or bicarbonate salt capable of yielding carbon 14 labeled $CO_2$ when reacted with acid. The tracer-forming solution preferably contains enough substantially neutral salt and pH-adjusting acid or base material to provide a composition which is at least compatible with, if not substantially similar to, or is a portion of, the aqueous liquid present in the reservoir to be tested. Where the so-labeled carbonates are used, the combination of the kinds and amounts of acid-generating material and tagged carbonic acid salts are preferably tailored with respect to the reservoir temperature to provide readily detectable amounts of carbon 14 labeled $CO_2$ and hydroxycarboxylic acid anions or other selectively water soluble water-phase tracers in the respective mobile and immobile liquid phases in the reservoir. In addition, what is important is that, at least by the end of the soak period within the reservoir, the tracer forming solution contains enough carbonic acid salt to generate sufficient carbon dioxide (by reacting with the acid formed by the acid-generating material) as well as containing enough water-phase tracer material to provide recognizable arrivals of the respective tracers in the presence of the other soluble materials present in the reservoir.

The patterns of the concentrations with amounts of fluid produced from the reservoir being tested (and/or concentrations with time, where the production rate is substantially constant) can be measured by currently known and available chemical and/or radioactive analytical methods and apparatus. It is a distinctive advantage of the present process that known and available relatively simple procedures, such as radiation counting, titrometric and/or thermometric analyses, can be utilized to measure all or part of the data needed for determining the chromatographic separation between the $CO_2$ partitioned between the phases and the acid anions or other water tracer dissolved substantially completely in the mobile phase of the reservoir fluid.

What is claimed is:

1. A process for determining the oil saturation in a reservoir, penetrated by at least one well, comprising:

preparing an aqueous carrier liquid solution containing solutes comprising:

(a) a acid-generating material, which is substantially oil-insoluble, (b) a carbonic acid salt, which is substantially oil-insoluble, and wherein at least one carbon atom of the carbonic acid salt molecule is $C^{14}$ and capable of forming a $C^{14}$ labeled $CO_2$ oil tracer, and (c) a radioactive water tracer, which is substantially oil-insoluble and substantially nonreactive with the reservoir;

injecting the aqueous carrier liquid solution into the reservoir;

displacing the aqueous carrier liquid solution within the reservoir with an aqueous displacement solution, which is substantially free of the acidgenerating material, the radioactive water tracer, and bicarbonate ions;

allowing the acid-generating material to form an acid, the acid to react with the carbonic acid salt to form a $C^{14}$ labeled $CO_2$ oil tracer, and the $CO_2$ oil tracer to partition between oil and water phases in the reservoir;

recovering tracer-containing fluid from the reservoir;

determining the chromatographic separation between the oil and the water tracers in the recovered fluid; and determining the oil saturation in the reservoir from the chromatographic separation.

2. The process of claim 1 wherein the oil saturation measured is a residual oil saturation.

3. The process of claim 1 wherein the acid-generating material is a halocarboxylic acid salt and an anion formed by hydrolysis of the halocarboxylic acid salt in the reservoir is used as an additional water tracer.

4. The process of claim 1 wherein the acid-generating material is an imide and an anion formed by hydrolysis of the imide in the reservoir is used as an additional water tracer.

5. The process of claim 1 wherein the chromatographic separation between the oil and water tracers in the recovered fluid is determined by measuring the radioactive emissions of the tracers.

6. The process of claim 1 wherein the recovered fluid is produced from a well through which the aqueous carrier liquid solution was injected.

7. The process of claim 1 wherein the recovered fluid is produced from a well different from that through which the aqueous carrier liquid solution was injected.

8. A process for determining the oil saturation in a reservoir, penetrated by at least one well, comprising:

preparing an aqueous carrier liquid solution containing solutes consisting essentially of:

(a) a halocarboxylic acid salt, which serves as an acid generating material and is substantially oil-insoluble, (b) a carbonic acid salt, which is substantially oil-insoluble, and wherein at least one carbon atom of the carbonic acid salt molecule is $C^{14}$ and capable of forming a $C^{14}$ labeled $CO_2$ oil tracer, and (c) a radioactive water tracer, which is substantially oil-insoluble and substantially nonreactive with the reservoir;

injecting the aqueous carrier liquid solution into the reservoir;

displacing the aqueous carrier liquid solution within the reservoir with an aqueous displacement solution, which is substantially free of the halocarboxylic acid salt, the radioactive water tracer, and of bicarbonate ions;

allowing the halocarboxylic acid salt to form an acid, the acid to react with the carbonic acid salt to form a $C^{14}$ labeled $CO_2$ oil tracer, and the $CO_2$ oil tracer to partition between oil and water phases in the reservoir;

recovering tracer-containing fluid from the reservoir;

determining the chromatographic separation between the oil and the water tracers in the recovered fluid; and determining the oil saturation in the reservoir from the chromatographic separation.

* * * * *